United States Patent [19]

Meijer

[11] Patent Number: 4,901,790

[45] Date of Patent: Feb. 20, 1990

[54] SELF-HEATED DIFFUSER ASSEMBLY FOR A HEAT PIPE

[75] Inventor: Roelf J. Meijer, Ann Arbor, Mich.

[73] Assignee: Stirling Thermal Motors, Inc., Ann Arbor, Mich.

[21] Appl. No.: 354,857

[22] Filed: May 22, 1989

[51] Int. Cl.[4] ..... F28D 15/02

[52] U.S. Cl. ..... 165/104.27; 165/917; 55/158

[58] Field of Search ..... 165/104.27, 917; 55/158

[56] References Cited

U.S. PATENT DOCUMENTS 3,503,438 3/1970 Geyer ..... 165/104.27

FOREIGN PATENT DOCUMENTS 41360 3/1980 Japan ..... 165/104.27

*Primary Examiner*—Albert W. Davis Jr.

*Attorney, Agent, or Firm*—Harness, Dickey & Pierce

[57] ABSTRACT

A diffuser unit for allowing non-condensing gases collecting within a heat pipe to be eliminated. The embodiments described herein define a cavity for collection of non-condensing gases such as hydrogen. The housings are arranged such that the heat pipe working fluid in vapor form transfers heat to the walls of the housing defining the collection cavity to raise the wall temperature thus increasing its permeability to the non-condensing gas. Accordingly, when the heat pipe is used in applications where non-condensing gases such as hydrogen tend to diffuse into the heat pipe such as when it is directly heated by a hydrocarbon combustion, such non-condensing gases can be readily eliminated. Such diffusion of non-condensing gases occurs without the requirement of providing a conventional "getter" which uses special material for absorbing or breaking down such non-condensing gases. The diffuser assemblies in accordance with this invention are self-regulating and entirely passive in operation, requiring no external heat inputs or control signals.

8 Claims, 2 Drawing Sheets

SELF-HEATED DIFFUSER ASSEMBLY FOR A HEAT PIPE

BACKGROUND AND SUMMARY OF THE INVENTION

This invention relates to an apparatus for removing non-condensing gases such as hydrogen from a heat pipe and particularly to one that does not require auxiliary heating systems for operation.

Heat pipes are heat transfer devices which provide high heat transport efficiency. Heat pipes have an enclosed cavity filled with a condensible heat transfer medium. Heat is put into the heat pipe at an evaporator section where the working fluid is vaporized and the vapor travels to a condensor section of the heat pipe where it condenses, thereby giving up heat which is radiated or conducted to an external load or sink. The condensed working fluid is then returned to the evaporator section typically by refluxing or through a wick which conducts the liquid by capillary action.

Heat pipe systems are employed in numerous applications in industry. The assignee of the present invention, Stirling Thermal Motors, is involved in the research and development of Stirling cycle engines. Such engines can be designed to receive heat inputs from various sources. In one system, a hydrocarbon fuel such as natural gas is burned and the flue gases heat the evaporator section of a heat pipe. The heat pipe working medium transports this heat to the heat exchanger of the Stirling engine.

To insure efficient operation of a heat pipe, it is necessary to minimize the amount of non-condensing gases which are present inside the heat pipe. Such gases tend to collect in the condensor section of the heat pipe since they are forced there by the flow of vaporized working medium. These non-condensing gases prevent the working medium from reaching portions of the condensor and, consequently, such areas cool down which reduces the efficiency of the heat pipe.

During initial charging of the heat pipe, great care is taken to insure that non-condensing gases such as hydrogen are not introduced into the heat pipe. However, during use, hydrogen and other non-condensing gases are able to permeate the heat pipe housing and may reach concentrations where they interfere with operation of the heat pipe, as explained previously. Such problems are particularly prevalent when directly heating a heat pipe evaporator section by combustion of a hydrocarbon fuel since the combustion products tend to contain hydrogen, especially if the air/fuel ratio is rich (i.e., excess fuel). It is difficult, if not impossible, to prevent hydrogen from diffusing through the heat pipe housing due to the minute size of the hydrogen nucleus once its free electron is stripped The permeability of the material of the heat pipe housing to gases is further increased due to the high temperature of the evaporator section.

Various techniques for removing non-condensing gases within a heat pipe have been proposed. In one approach, a conventional "getter" is used for absorbing the non-condensing gases. As disclosed in applicants+ copending U.S. Pat. application Ser. No. 233,732, filed on Aug. 19, 1988, and entitled "Shell And Tube Heat Pipe Condenser", applicants disclose the use of calcium or lanthanum as materials capable of absorbing non-condensing gas from within a heat pipe. These materials must be heated to at least 600° C. in order to operate satisfactorily. Such heating requires the use of an auxiliary heater such as an electric cartridge heater to degas the unit.

Although getter units employing degasing agents generally perform satisfactorily, they have several drawbacks. Applicants have found that in some applications when sodium is used as a heat pipe working medium, liquid sodium can combine with the getter material to form alloys which have a high melting point. These alloys can find their way into the evaporator section where they contaminate the liquid distribution wick, which can lead to uneven flow of liquid working medium to the surfaces of the evaporator. Another disadvantage of using such conventional getters is the fact that they require auxiliary heating and control systems to operate satisfactorily. Such control problems are aggravated by the fact that, during the cool down mode of the heat pipe, it is necessary to insure that the getter unit remains at a higher temperature than the remainder of the heat pipe to prevent the working medium from condensing in the getter which would aggravate the contamination problems discussed above.

In accordance with the present invention, several designs of self-heated diffuser units are provided which do not require the use of a conventional getter. The devices are passive in that they do not require outside energy inputs or control signals to operate. The devices include a cavity for collecting non-condensing gases and means for employing the heat pipe working fluid vapor to heat the walls surrounding the collection cavity which increases their permeability to the non-condensing gases, allowing them to diffuse through the collection cavity wall to the atmosphere. The diffusivity characteristic can be enhanced through a proper selection of the materials making up the collection cavity walls, for example, by making it from nickel or a nickel alloy.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
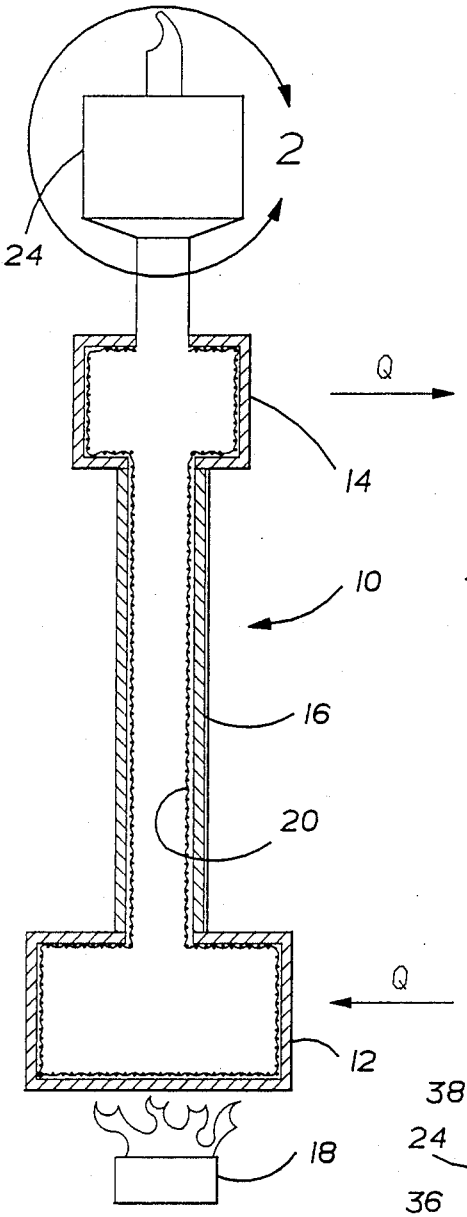
FIG. 1 is a pictorial view of a representative heat pipe incorporating a self-heated diffuser according to a first embodiment of this invention.

A heat pipe system incorporating the features of the present invention is diagrammatically illustrated in FIG. 1 and is generally designated by reference number 10. Heat pipe 10 principally comprises evaporator section 12, condensor section 14 and transport tube 16 communicating them. Evaporator section 12 receives heat inputs through combustor 18 (shown diagrammatically) and heat is removed from condensor section 14. Heat pipe 10 is hollow and filled with a working medium. Various materials can be used as a heat pipe working medium. For many applications used by applicant, sodium is used as a working medium. The working medium is vaporized in evaporator section 12 and flows to the condensor section 14 where it condenses, thereby giving up heat. Wick 20 lines various portions of the heat pipe and can be used to transport condensed working fluid by capillary action. Diffuser assembly 24 communicates with condensor section 14 which is described in detail below.

In the example shown in FIG. 1, during operation of heat pipe 10, vapor flows upwardly through transport tube 16. Any non-condensing gases such as hydrogen within the heat pipe are forced, due to this vapor flow, to collect within condensor section 14. If these gases collect in a significant quantity, they disrupt proper heat transfer operation as explained above.

In accordance with this invention, diffuser assembly 24 is provided for removing non-condensing gases such as hydrogen from the interior of heat pipe 10. Diffuser assembly 24 according to a first embodiment of this invention is shown in detail in FIG. 2. Diffuser assembly 24 includes a cylindrical outer housing 26 which defines the outer wall of the device. Housing 26 communicates with condensor section 14 via connection tube 28. Inside of housing 26 is cup 30 which has a generally closed lower end 31. The upper edge of cup 30 defines a number of apertures 32 spaced circumferentially around the cup. Cover 34 encloses the top of housing 26 and cup 30. Inside of cup 30 is inverted collection cup 36 which has a double outer wall 38 which joins top plate 34. Double wall 38 is formed from tubes 42 and 43 which are welded together at their lower end and define a narrow gap 40 which opens to atmosphere at the top of the unit. Tube 46 is connected to end plate 44 which encloses the top of collection cup 36.

The lower surface of cup 30 is covered by wick 48 which communicates with wick bundle 50 and passes through a small aperture 52 through cup 30. Tube 46 is provided for evacuation of heat pipe 10. Once evacuation is completed, tube 46 is crimped and welded shut.

Figure 2:
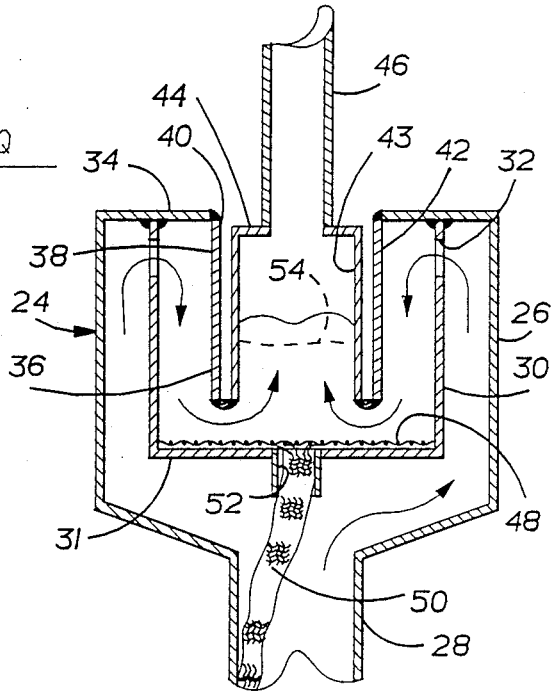
FIG. 2 is a cross-sectional view taken along line 2—2 of FIG. 1 showing the internal construction of the diffuser shown in FIG. 1 according to a first embodiment of this invention.

In operation of heat pipe 10, when non-condensing gases such as hydrogen are present within the heat pipe, they are forced into diffuser assembly 24 due to vapor flow action as discussed previously. When the non-condensing gases and vapor enter the unit via connection tube 28, they are initially forced upwardly through the annulus around cup 30 and flow n a radially inward direction through apertures 32, as shown by the arrows in FIG. 2. The vapor and gases thereafter flow downwardly through the annulus between cups 30 and 36 and finally reach the collection cavity defined by the inside of collection cup 36. In the event that significant amounts of non-condensing gases are present in the system, they are forced due to the vapor flow action to gather within collection cup 36. Dotted line 54 in FIG. 2 shows a representative quantity of non-condensing gas such as hydrogen which has collected within collection cup 36 during operation. Since this quantity of non-condensing gas prevents vapor from reaching the inside surface of collection cup 36, that surface tends to cool down. However, due to the close proximity of tube 43 to tube 42 which is at an elevated temperature due to the flow of vaporized working medium which contacts it, tube 43 is heated through radiation and convection heat transfer. The elevated temperature of collection cup 36 causes its permeability to hydrogen gas and other non-condensing gases to be increased thereby allowing such gases to escape diffuser assembly 24. To enhance this diffusivity characteristic, tubes 42 and 43 and plate 44 can be made of a high permeability metal such as nickel or a nickel alloy. Accordingly, in operation, in the event that hydrogen or other non-condensing gases enter the heat pipe due to the increased temperature of the evaporator section 12 of the heat pipe, these gases will be eliminated by the very same mechanism, i.e., diffusion through a high temperature metal barrier within diffuser assembly 24.

Since some heat is necessarily lost from diffuser assembly 24, some condensation of the heat pipe working fluid will occur in the diffuser. Accordingly, a means for removing liquid working medium is provided. Wick layer 48 and bundle 50 receive liquified working fluid and conduct it via capillary action back to evaporator section 12. The total heat loss from diffuser 24 can be minimized by insulating the outer surfaces of the unit. Alternatively, a simple gravity return system could be used which does not require a wick.

Figure 3:
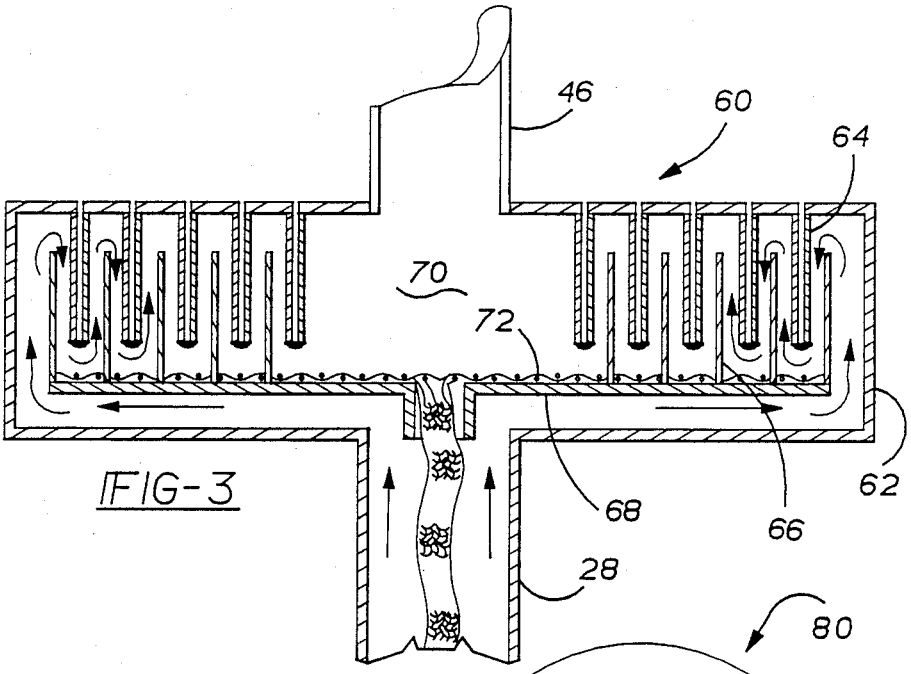
FIG. 3 is a cross-sectional view through a diffuser according to a second embodiment of this invention.

FIG. 3 illustrates diffuser assembly 60 according to a second embodiment of this invention which is similar in its manner of operation to the first embodiment, except that multiple stages are provided giving this embodiment a greater capacity to remove large volumes of non-condensing gases. For this embodiment, a series of double walls 64 are provided with separator walls 66 extending upwardly from base plate 68. Like the prior embodiment, each of double walls 64 defines an open gap exposed to the atmosphere. In operation, hydrogen gas or other non-condensible gases flow to the collection cavity 70 follow a serpentine path from the radially outer wall defined by housing 62 of the diffuser into its center. Like the prior embodiment, wick 72 and bundle 74 are provided for the transmission of condensed working medium from getter assembly 60. Elements of diffuser assembly 60 which are functionally identical to those of the first embodiment of this invention are identified by like reference numbers. In operation, diffuser assembly 60 operates in a manner identical to diffuser 24 except that several of the double walls are operative to eliminate non-condensing gases.

Figure 4:
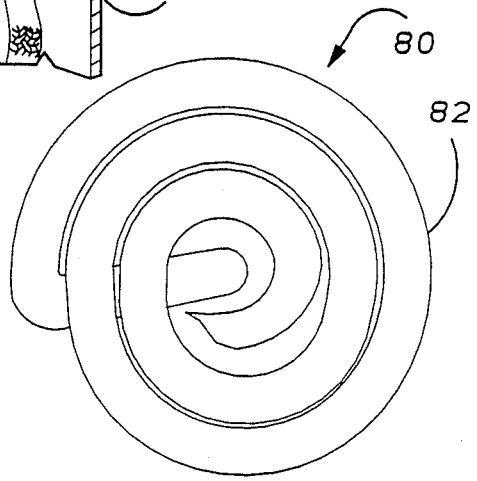
FIG. 4 is a plan view of a diffuser according to a third embodiment of this invention.
Figure 5:
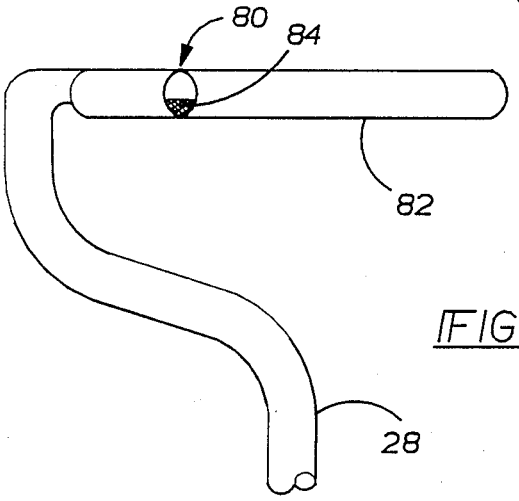
FIG. 5 is an elevational view, partially in section, of the diffuser shown in FIG. 4.

With reference to FIGS. 4 and 5, a third embodiment of a diffuser assembly is shown which is generally designated by reference number 80. Diffuser assembly 80 is formed by a long tube 82 wrapped in the form of a helix and oriented in a generally horizontal plane. The center of tube 82 is pinched off to define a cavity for the collection of non-condensing gases. Diffuser assembly 80 is tightly wound such that the walls o adjacent turns are close together so that heat transfer between them occurs. Wick bundle 84 is placed within tube 82 as shown best in FIG. 5 and serves to return condensed working fluid to heat pipe 10.

In operation of diffuser assembly 80, once a volume of non-condensing gas gathers at the end of tube 82, the outer wall surfaces of that tube are heated from adjacent wraps of the tube, thus increasing the tube's diffusivity for the escape of the non-condensing gas, as explained in connection with the prior embodiments.

While the above description constitutes the preferred embodiments of the present invention, it will be appreciated that the invention is susceptible of modification, variation and change without departing from the proper scope and fair meaining of the accompanying claims.

I claim:

1. A heat pipe having a housing defining a closed cavity containing a condensible heat transfer medium and defining an evaporator section for vaporizing said medium in response to a heat input and a condensor section where said medium condenses thereby giving off heat, said heat pipe including a diffuser assembly for eliminating non-condensing gases from within said heat pipe comprising:

a diffuser housing communicating with said heat pipe housing defining a working fluid flow path and a collection cavity such that said non-condensing gases collects in said collection cavity due to flow of said working fluid vapor, and wall means defined by said diffuser housing for transferring heat from said working medium flowing in said diffuser housing to wall portions defining said collection cavity thereby causing the permeability of said collection cavity wall portions to increase allowing said non-condensing gases to escape from said heat pipe.

2. A heat pipe as set forth in claim 1 wherein said collection cavity wall portions are made of material containing nickel.

3. A heat pipe as set forth in claim 1 wherein said diffuser housing includes an enclosed outer wall, a first cup within said outer wall defining a working medium flow path at its upper portion with a substantially closed bottom end and a second collection cup having a double wall with the gap between the walls, said collection cup having a substantially open bottom end and a closed upper end whereby said working medium flows into said diffuser housing upwardly between said outer wall and said first cup, into said first cup through said working fluid path, downwardly between said first and second cup and into said collection cup, such that any of said non-condensing gas collecting in said second cup dissipates through said double wall as said double wall is heated by said working medium.

4. A heat pipe as set forth in claim 3 wherein said first cup has an aperture in said bottom surface for draining of liquid working medium condensed within said diffuser housing.

5. A heat pipe as set forth in claim 3 wherein said double wall defines a gap exposed to atmosphere allowing said non-condensing gas to escape after permeating said collection cup wall.

6. A heat pipe as set forth in claim 1 wherein said diffuser housing is at least partially lined with a mesh wick for conducting condensed medium from said diffuser housing.

7. A heat pipe as set forth in claim 1 wherein said diffuser housing includes an enclosed outer wall, a plurality of cylindrical walls of decreasing diameter mounted to a bottom plate, a plurality of cylindrical double walls positioned between said cylindrical walls, said double walls defining a gap exposed to atmosphere whereby non-condensing gases collecting within said diffuser dissipate through said double walls which are heated by said working fluid vapor.

8. A heat pipe as set forth in claim 1 wherein said diffuser housing is in the form of a spiral tube having more than one wrap and defining a generally horizontal plane and wherein a closed end of said tube defines said collection cavity and wherein turns of said spiral tubes adjacent said closed end heat said collection cavity tube wall.

* * * * *